US010123930B2

(12) United States Patent
McBride et al.

(10) Patent No.: US 10,123,930 B2
(45) Date of Patent: Nov. 13, 2018

(54) STANDING TRACTION DEVICE

(71) Applicant: STAMINA PRODUCTS, INC., Springfield, MO (US)

(72) Inventors: Robert McBride, Springfield, MO (US); Tyler Rogers, Springfield, MO (US); Siz-Pin Lin, Taichung (TW)

(73) Assignee: Stamina Products, Inc., Springfield, MO (US)

( * ) Notice: Subject to any disclaimer, the term of this patent is extended or adjusted under 35 U.S.C. 154(b) by 38 days.

(21) Appl. No.: 14/264,470

(22) Filed: Apr. 29, 2014

(65) Prior Publication Data

US 2014/0323278 A1 Oct. 30, 2014

Related U.S. Application Data

(60) Provisional application No. 61/817,622, filed on Apr. 30, 2013.

(51) Int. Cl.

| | |
|---|---|
| ***A63B 5/08*** | (2006.01) |
| ***A63B 5/10*** | (2006.01) |
| ***A63B 21/062*** | (2006.01) |
| ***A63B 26/00*** | (2006.01) |
| ***A61H 1/00*** | (2006.01) |
| ***A61H 1/02*** | (2006.01) |

(52) U.S. Cl.

CPC ..... *A61H 1/0292* (2013.01); *A61H 1/0229* (2013.01); *A61H 2201/1284* (2013.01); *A61H 2201/1614* (2013.01); *A61H 2201/1628* (2013.01)

(58) Field of Classification Search

CPC .. A61H 1/0292; A61H 1/0229; A61H 1/0218; A61H 1/0222; A63B 23/0233; A63B 23/0238; A63B 21/0615; A63B 21/068; A63B 23/02

USPC ..... 482/144

See application file for complete search history.

(56) References Cited

U.S. PATENT DOCUMENTS

| | | | | | |
|---|---|---|---|---|---|
| 3,491,385 | A | * | 1/1970 | Werner | 5/633 |
| 4,292,962 | A | * | 10/1981 | Krause | 606/244 |
| 4,915,101 | A | * | 4/1990 | Cuccia | 606/244 |
| 5,094,445 | A | * | 3/1992 | Winkelvoss | 482/42 |
| 5,163,890 | A | * | 11/1992 | Perry, Jr. | 482/142 |
| 5,180,161 | A | * | 1/1993 | Jordan | 482/143 |
| 5,190,513 | A | * | 3/1993 | Habing et al. | 482/145 |
| 5,217,487 | A | * | 6/1993 | Engel et al. | 606/240 |
| 5,472,401 | A | * | 12/1995 | Rouillard | A63B 23/0233 482/142 |
| 5,551,937 | A | * | 9/1996 | Kwo | 482/144 |

(Continued)

*Primary Examiner* — Nyca T Nguyen

(74) *Attorney, Agent, or Firm* — Pillsbury Winthrop Shaw Pittman LLP

(57) ABSTRACT

An exercise apparatus includes an adjustable support frame configured be adjusted to raise or lower a waist portion thereof to accommodate users of different heights standing adjacent thereto on a support surface. The exercise apparatus also includes a pivotal upper body support constructed and arranged to pivot relative to the support frame. The upper body support is configured to receive a torso of a user standing adjacent to the adjustable support frame, and facilitate a traction exercise to stretch a spine of the user when the torso of the user engages the pivotal upper body support and bends over the support frame.

18 Claims, 8 Drawing Sheets

(56) References Cited

U.S. PATENT DOCUMENTS

| | | | | | |
|---|---|---|---|---|---|
| 5,840,001 | A * | 11/1998 | Schedel | 482/142 | |
| 5,860,899 | A * | 1/1999 | Rassman | 482/142 | |
| 5,922,011 | A * | 7/1999 | Cuccia | A61H 1/0229 | 606/241 |
| 5,971,902 | A * | 10/1999 | Robertson et al. | 482/142 | |
| 7,442,153 | B1 * | 10/2008 | Chasnov | 482/142 | |
| 7,699,763 | B2 * | 4/2010 | Perry, Jr. | 482/144 | |
| 2003/0216781 | A1 * | 11/2003 | Cuccia | A61G 13/009 | 606/237 |
| 2006/0100070 | A1 * | 5/2006 | Abdo | 482/121 | |
| 2011/0040219 | A1 * | 2/2011 | Tanner et al. | 601/128 | |
| 2012/0104711 | A1 * | 5/2012 | Alexander | A61G 5/00 | 280/47.34 |
| 2014/0309573 | A1 * | 10/2014 | Tillotson | 602/36 | |

* cited by examiner

STANDING TRACTION DEVICE

CROSS-REFERENCE TO RELATED APPLICATIONS

This application claims priority and benefit under 35 U.S.C. § 119(e) to U.S. Provisional Patent Application No. 61/817,622, filed on Apr. 30, 2013, the content of which is incorporated herein by reference in its entirety.

FIELD

The present disclosure relates to the field of exercise equipment, and more in particular to an exercise device configured to stretch and decompress the spine of a user.

BACKGROUND

In order to promote good health and physical well-being, many individuals engage in physical exercise. It is common for individuals who are engaging in physical activities to employ the use of exercise devices to assist in performing exercises. Some exercise devices and exercises are configured for rehabilitation or recovery. One type of exercise device is configured to stretch and decompress the spine of a user, which may relieve pressure on pinched nerves in the spinal column, for example.

SUMMARY

According to an embodiment, an exercise apparatus includes an adjustable support frame configured be adjusted to raise or lower a waist portion thereof to accommodate users of different heights standing adjacent thereto on a support surface. The exercise apparatus also includes a pivotal upper body support constructed and arranged to pivot relative to the support frame. The upper body support is configured to receive a torso of a user standing adjacent to the adjustable support frame, and facilitate a traction exercise to stretch a spine of the user when the torso of the user engages the pivotal upper body support and bends over the support frame.

According to another embodiment, a method of exercising using an exercise apparatus is provided. The exercise apparatus includes an adjustable support frame configured be adjusted to raise or lower a waist portion thereof to accommodate users of different heights standing adjacent thereto on a support surface, and a pivotal upper body support constructed and arranged to pivot relative to the support frame, wherein the pivotal upper body support is configured to receive a torso of the user standing adjacent to the adjustable support frame. The method includes standing adjacent to the exercise apparatus with the waist portion adjusted to accommodate a height of the user. The method also includes engaging the pivotal upper body support with the torso of the user while standing adjacent to the exercise apparatus. The method further includes bending over the waist portion and pivoting the pivotal upper body support while the user is standing, to stretch the spine of the user.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation. In addition, it should be appreciated that structural features shown or described in any one embodiment herein can be used in other embodiments as well. It is to be expressly understood, however, that the drawings are for the purpose of illustration and description only. As used in the specification and in the claims, the singular form of "a", "an", and "the" include plural referents unless the context clearly dictates otherwise.

BRIEF DESCRIPTION OF THE DRAWINGS

Features of the disclosure are shown in the drawings, in which like reference numerals designate like elements. The drawings form part of this original disclosure in which.

DETAILED DESCRIPTION OF THE ILLUSTRATED EMBODIMENTS

Figure 1:
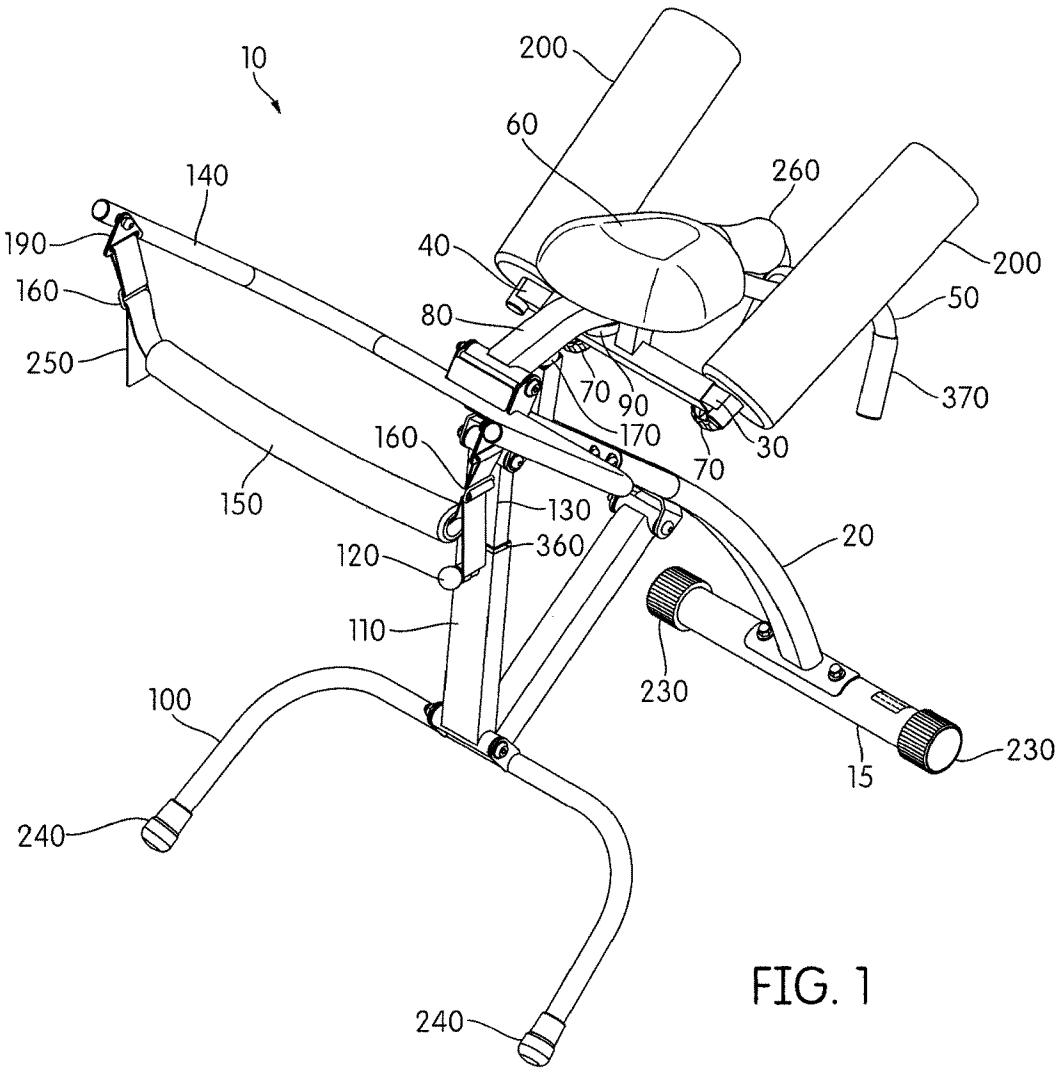
FIG. 1 illustrates an embodiment of a standing traction device.

FIG. 1 illustrates an embodiment of a standing traction device 10, configured to be supported on a support surface. As shown, and described in greater detail below, the standing traction device 10 is configured for a user to conduct a spinal decompression (e.g., stretch) exercise while standing adjacent thereto. To support the standing traction device 10 on the support surface, the standing traction device 10 may include a front stabilizer 15, which in some embodiments may be elongated to extend horizontally on the support surface. A front support 20 may be coupled to and/or extend from the front stabilizer 15, and may assist in elevating a main frame 140 in an elevated position. The main frame 140 is described in greater detail below.

As shown in FIG. 1, a rear support 100 may be pivotally coupled to the main frame 140. Adjusting an angle between the rear support 100 and the front support 20 may elevate the main frame 140 relative to the support surface (e.g., by reducing a distance between the front stabilizer 15 and the ends of the rear support 100 adjacent to the support surface). In an embodiment, the spacing between portions of the rear support 100 at the support surface and the front stabilizer 15 coupled to the front support 20 may be configured to typically establish a balanced plane of contact on the support surface. In an embodiment, the angle between the rear support 100 and the front stabilizer 15 may be reduced significantly, so as to place the standing traction device 10 in a storage configuration (e.g., where the standing traction device 10 might not be able to support the main frame 140 in the elevated position due to the compact distance between the front stabilizer 15 and the rear support 100). In the illustrated embodiment, endcaps 230 may be positioned on the front stabilizer 15 to provide frictional engagement and/or cushioned engagement with the support surface. Similarly, dome endcaps 240 may be positioned on the ends of the rear support 100, which may also provide frictional and/or cushioned engagement with the support surface. As shown in the illustrated embodiment, in some embodiments the rear support 100 may comprise a U-shaped configuration (or a similar configuration) that may provide a space between the ends thereof for the user to stand therebetween. In another embodiment, the rear support 100 may comprise a member configured to extend between the user's feet, which either may couple to its own associated stabilizer (e.g., a rear stabilizer), or may provide for a tripod-like support with the front stabilizer 15.

In an embodiment, such as that shown, an adjustable linkage may be pivotally coupled to both the rear support 100 and the main frame 140, which may be configured to lock the rear support 100 at one of a plurality of positions to raise the main frame 140 at a desired elevation above the support surface. In another embodiment, the adjustable linkage may be pivotally coupled to a portion of the front support 20 spaced from where the rear support 100 pivotally links to the front support 20. Other configurations of the adjustable linkage are alternatively possible, configured to selectively bring the main frame 140 to a desired elevation above the support surface. As shown in FIG. 1, the adjustable linkage may comprise an outer tube 110 with a spring pin 120 secured thereto, and an inner tube 130 received therein. In an embodiment, a sleeve 360 may separate the outer tube 110 from the inner tube 130 (and may be formed from a material configured to prevent scraping of metal on metal during slidable movement of the inner tube 130 relative to the outer tube 110. The inner tube 130 may have a plurality of apertures formed extending along its length, configured to receive a protruding portion of the spring pin 120. Accordingly, retracting the spring pin 120 from the inner tube 130 (e.g., at least to the sleeve 360 where present) may facilitate slidable movement between the inner tube 130 and the outer tube 110, so as to modify the adjustable linkage to create a different arrangement between the rear support 100 and the front support 20 and/or the main frame 140.

Further secured to the main frame 140 may be a roller portion 150 which may provide a pivot region for a user of the standing traction device 10, as described in greater detail below. As shown, in an embodiment the roller portion 150 may be coupled to the main frame 140 by a belt 250, which may extend through the roller portion 150, and may hang from hooks 190 secured to protruding portions of the main frame 140 (and may, for example, overhang the rear support 100). It may be appreciated that the hooks 190 may allow the belt 250 and the roller portion 150 to pivot relative to the main frame 140. For example, a user of the standing traction device 10 may lean against the roller portion 150, which may move towards the front support 20 at the pivot points of the hooks 190. Additionally, the belt 250 may be adjustable in some embodiments, allowing the roller portion 150 to be positioned closer to or further away from the hooks 190 (and thus allowing the roller portion 150 to be positioned closer to or further away from the front support 20 as a user leans against the roller portion 150). For example, in the illustrated embodiment a length of the belt 250 between the hooks 190 may be modified by securing an excess amount through a buckle 160. Other mechanisms for expanding or contracting a functional length of the belt 250 may alternatively be utilized in other embodiments. In an embodiment, the roller portion 150 may be formed as a foam roller, where the foam of the foam roller may surround the belt 250 and may have sufficient spacing therebetween to facilitate at least some rotation of the roller portion 150 about the belt 250.

It may be appreciated that a user of the standing traction device 10 may lean against the roller portion 150 and engage a pivoting assembly that is pivotally mounted to the main frame 140. Specifically, as shown, the pivoting assembly includes a swing arm 80 that includes a handlebar portion 50, and is configured to extend over the front support 20. In some embodiments, such as that illustrated, the swing arm 80 may be configured to pivot away from or towards a bumper 170 protruding from the main frame 140. In an embodiment, the bumper 170 may be of a generally soft or resilient material configured to absorb impact as the pivoting assembly (and specifically, the swing arm 80) is moved by the user or is otherwise released to fall towards the portions of the main frame 140 and the front support 20 underneath. As shown in FIG. 1, the handlebar portion 50 may be wrapped in or otherwise coupled to a hand grip 370, which may be formed from a higher friction material than the handlebar portion 50, providing a grasping surface. In some embodiments the hand grip 370 may be integrally formed into the handlebar portion 50. In an embodiment, the hand grip 370 may include grooves therein configured to receive fingers of the user. As the user of the standing traction device 10 leans against the roller portion 150, the chest of the user may rest on a cushion 60 mounted to the swing arm 80. In the illustrated embodiment, the cushion 60 may be slidable along the swing arm 80, facilitating positioning at a desired part of the user's chest. In an embodiment, locking knobs 90 may be utilized to tighten the cushion 60 to the swing arm 40. As further shown, in an embodiment the handlebar portion 50 may comprise thereon foam pads 260 spaced to provide surfaces against which a face of the user may rest during the traction exercises. It may be appreciated that the foam pads 260 are optional, and may be omitted, or may be replaced with other configurations of a face rest in some embodiments.

As shown in FIG. 1, the standing traction device 10 may be configured to surround the shoulders of the user. For example, in the illustrated embodiment arm pads 200 are mounted to the swing arm 80 to resist unintentional movement of the user away from the swing arm 80. The arm pads 200 may be configured to slide towards and away from the swing arm 80, creating an adjustable spacing therebetween. Accordingly, a user of the standing traction device 10 may adjust the arm pads 200 buttress their shoulders as they lean against the cushion 60 with their torso, and grasp the hand grips 370. As shown, in the illustrated embodiment the swing arm 80 includes outer tube portions that may receive a right arm pad tube 30 and a left arm pad tube 40 therein respectively. In an embodiment, adjustment knobs 70 may be received through the swing arm 80 and into a selected one of a plurality of apertures in each of the right arm pad tube 30 and left arm pad tube 40, allowing for adjustable selection of the relative positions thereof.

Figure 2:
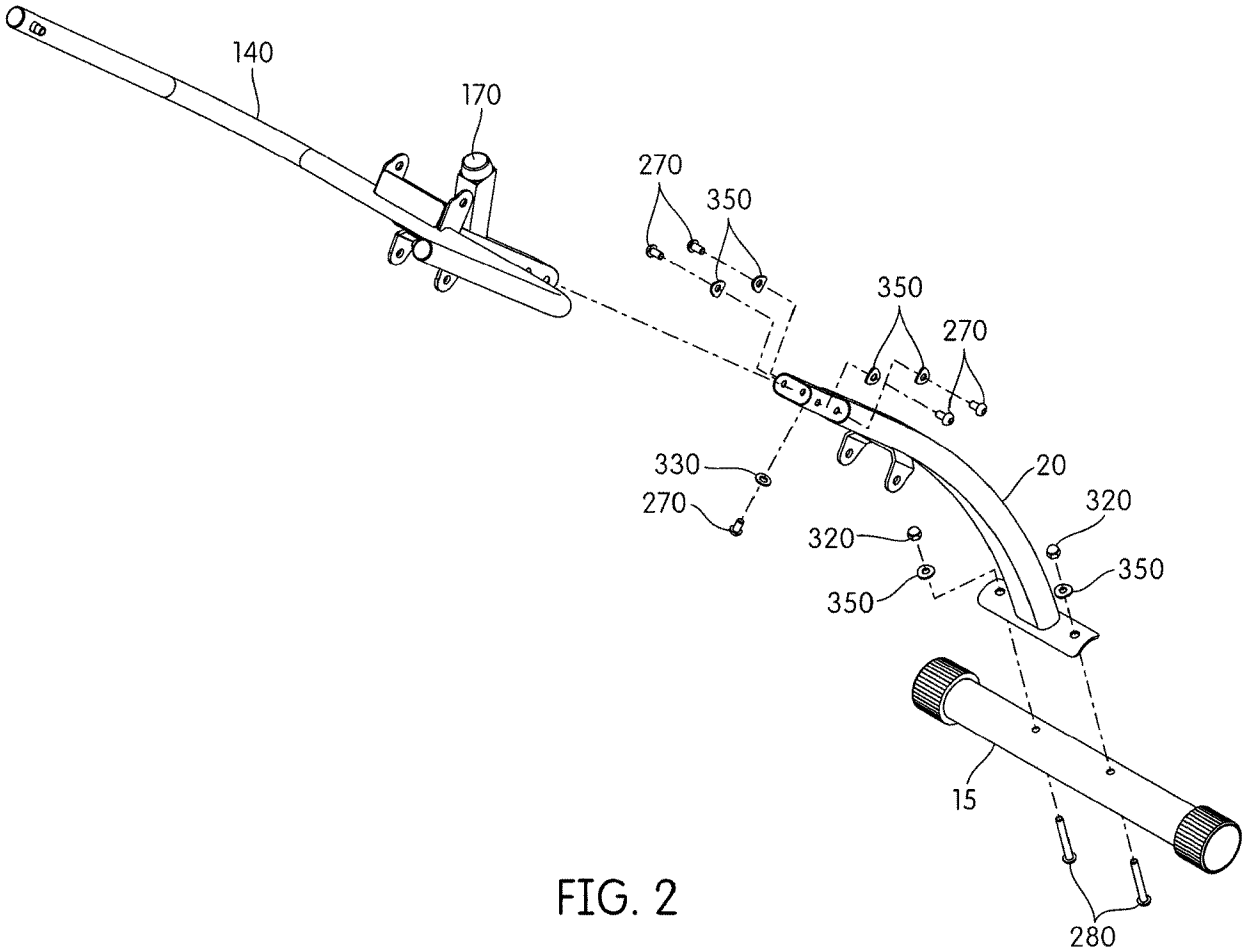
FIG. 2 illustrates an exploded view of a portion of the standing traction device of FIG. 1.

While in some embodiments components of the standing traction device 10 (e.g., those described above) may be integrally formed with one another, in an embodiment, the components may be separate, and may be secured to one another as an assembly. FIGS. 2-6 illustrate assembly of such an embodiment of the standing traction device 10. As shown in FIG. 2, the main frame 140 may be configured to define pivot points for both the swing arm 80 (to perform the traction exercise) and the inner tube 130 (for adjusting the position of the rear support 100). The main frame 140 may also include the bumper 170, which may protrude from a bumper support extending therefrom. In the illustrated embodiment the main frame 140 and the front support 20 are formed with a tubular construction, wherein a portion of the front support 20 may be slidably received in the main frame 140. In an embodiment, the main frame 140 may then be secured to the front support 20 via one or more fasteners. For example, in the illustrated embodiment, bolts 270 may be inserted through arc washers 350 into apertures on curved portions of the main frame 140 and the front support 20 (the apertures on each being aligned with one another in the slidable assembly). Likewise, in the illustrated embodiment a bolt 270 may be inserted through a flat washer 330 into flat portions of the main frame 140 and the front support 20 (the apertures on each being aligned with one another in the slidable assembly). A similar assembly may be utilized to secure the front support 20 to the front stabilizer 15. For example, in the illustrated embodiment bolts 280 may protrude through apertures in the front stabilizer 15, and through associated apertures in the front support 20. The bolts 280 may then extend through arc washers 350 and be secured by nuts 320 (specifically acorn nuts in the illustrated embodiment).

Figure 3:
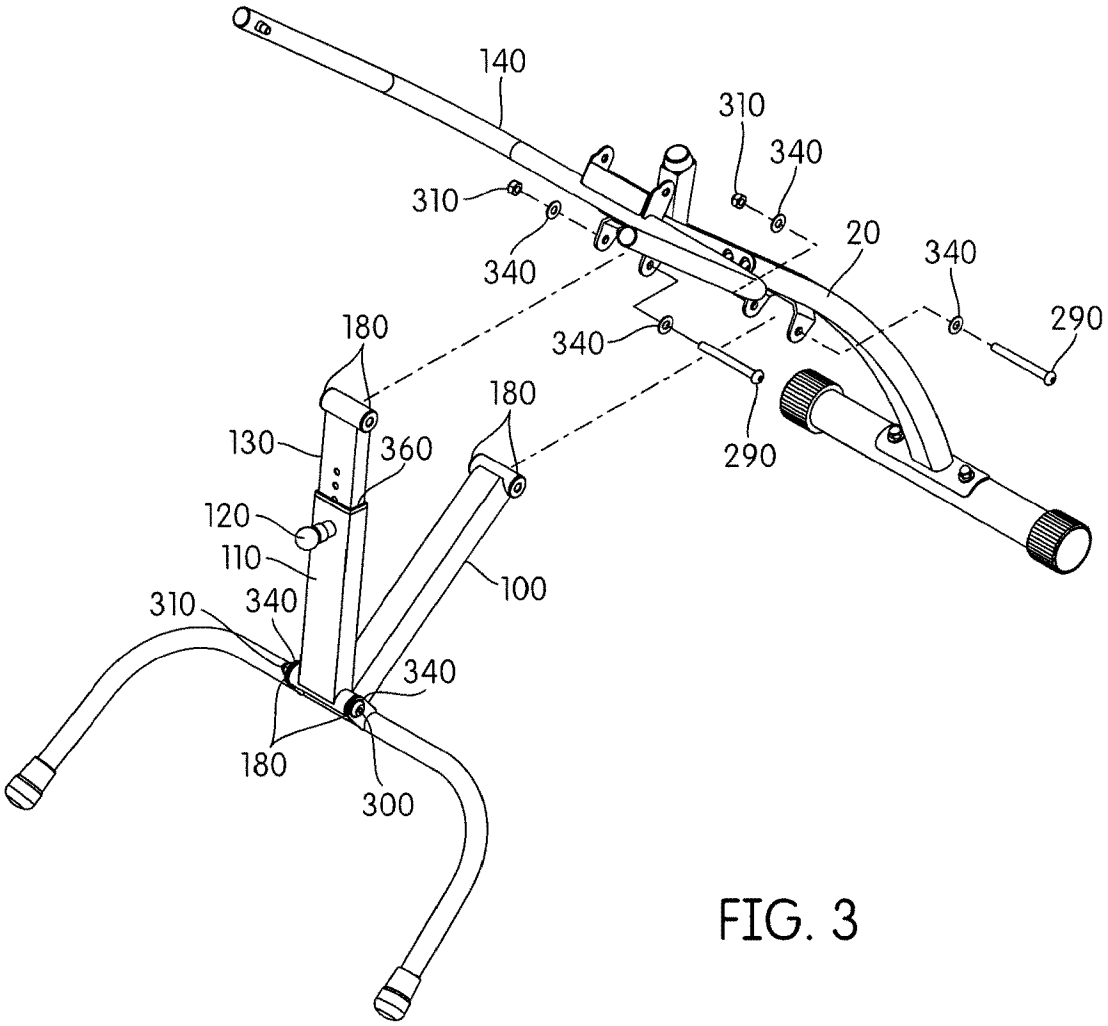
FIG. 3 illustrates an exploded view of another portion being assembled with the assembled portion of FIG. 2.

FIG. 3 illustrates assembly of the rear support 100 and the adjustable linkage onto the assembly of the main frame 140 and the front support 20. In an embodiment, the rear support 100, the outer tube 110, the inner tube 130 and the spring pin 120 may be delivered to consumers pre-assembled, in other embodiments any such assembly may be left to the consumer. As shown, in an embodiment the rear support 100 and the inner tube 130 may include bushings 180 inserted into tubular end portions. Such bushings 180 or similar features may be configured to facilitate pivoting thereat. In the illustrated embodiment, a bolt 290 may be inserted through a washer 340 into an aperture of the front support 20, the bushings 180 and associated end portion of the rear support 100, then back through another aperture in the front support 20, another washer 340, and be secured by a nut 310 (in particular a nylock nut in the illustrated embodiment). Such assembly may facilitate pivoting between the rear support 100 and the front support 20 via the bolt 290. Similarly, a bolt 290 may be inserted through a washer 340 into an aperture of the main frame 140, the bushings 180 and associated end portion of the inner tube 130, then back through another aperture in the main frame 140, another washer 340, and be secured by a nut 310 (in particular another nylock nut in the illustrated embodiment). In the illustrated embodiment the outer tube 110 is pivotable relative to the rear support 100 via a similar mechanism, with a bolt 300 (which is longer than the bolts 290 in the illustrated embodiment) passing therethrough and being secured by a nut 310. It may therefore be appreciated that the adjustable linkage may be formed by the pivotable coupling between the rear support 100 and the front support 20, and the further pivotable coupling between the outer tube 110 and the rear support 100 and between the inner tube 130 and the main frame 140. As described above, such assembly may facilitate the adjustable linkage being configured to raise and lower the main frame 140 relative to the support surface, to accommodate different heights of users of the standing traction device 10.

Figure 4:
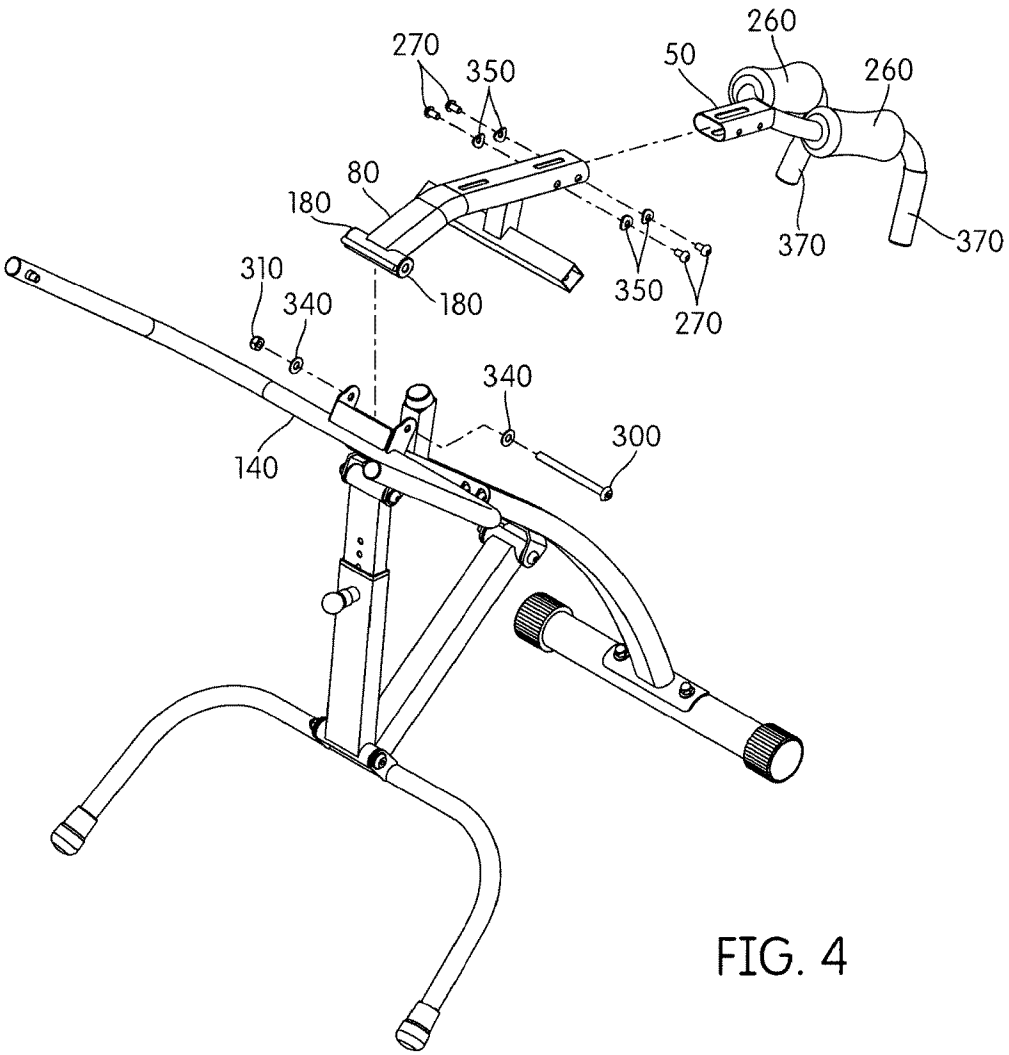
FIG. 4 illustrates an exploded view of another portion being assembled with the assembled portions of FIG. 2 and FIG. 3.

As shown in FIG. 4, the handlebar portion 50 may be slidably received over or into a portion of the swing arm 80. In the illustrated embodiment, apertures thereon may align, and the handlebar portion 50 may be secured by bolts 270 extending through arc washers 350 into apertures in the swing arm 80 and the handlebar portion 50. While in some embodiments the foam pads 260 and the hand grips 370 may be preassembled, integrally formed, or otherwise molded onto the handlebar portion 50, in other embodiments assembly thereof may be left to consumers and/or users of the standing traction device 10. As shown, a bolt 300 may extend through a washer 340, a portion of the main frame 140, bushings 180 and a portion of the swing arm 80, another portion of the main frame 140, another washer 340, and be secured by a nut 310. Such an assembly may facilitate pivoting of the assembly of the swing arm 80 and the handlebar portion 50 relative to the main frame 140. It may be appreciated that other mechanisms for such pivoting may be utilized in other embodiments.

Figure 5:
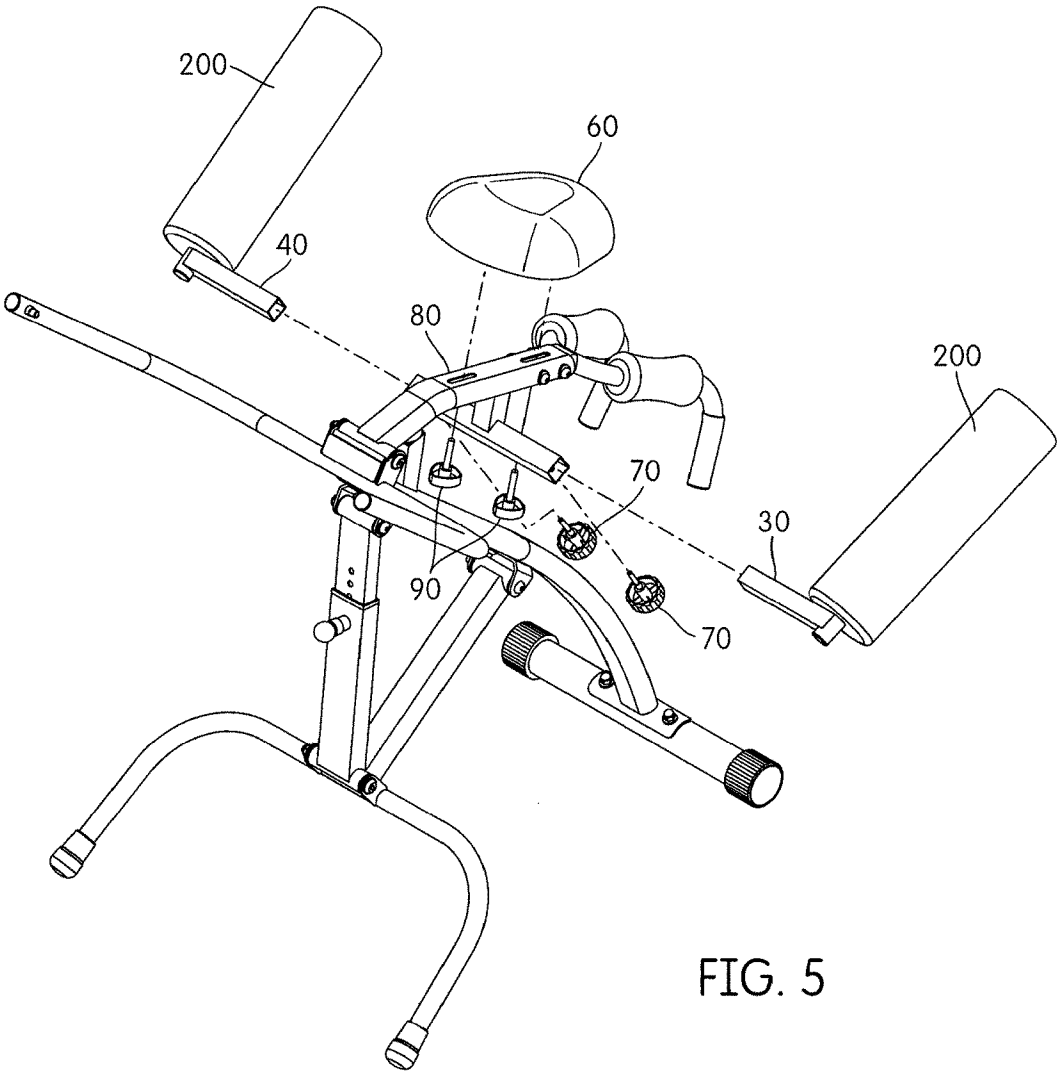
FIG. 5 illustrates an exploded view of another portion being assembled with the assembled portions of FIGS. 2-4.

FIG. 5 illustrates assembly of the cushion 60 and arm pads 200 onto the swing arm 80. As shown, the swing arm 80 may include elongated apertures therethrough, which may receive locking knobs 90 extending into receiving apertures in the cushion 60. It may be appreciated that the locking knobs 90 may be tightened to prevent slidable movement of the cushion 60 relative to the swing arm 80 during use of the standing traction device 10. In an embodiment the user of the standing traction device 10 may loosen the locking knobs 90 so as to facilitate slidable movement of the cushion 60 relative to the swing arm 80, to adjust the cushion 60 to a comfortable region of their chest as they are engaging the standing traction device 10. As shown, protruding ends of each of the right arm pad tube 30 and left arm pad tube 40 may also be received in associated apertures of the swing arm 80. A plurality of apertures formed in each of the right arm pad tube 30 and left arm pad tube 40 may be configured to receive respective adjustment knobs 70 to secure the right arm pad tube 30 and left arm pad tube 40 at desired positions relative to the swing arm 80 (and thus to each other), facilitating an adjustable space between the arm pads 200 associated with the right arm pad tube 30 and left arm pad tube 40.

Figure 6:
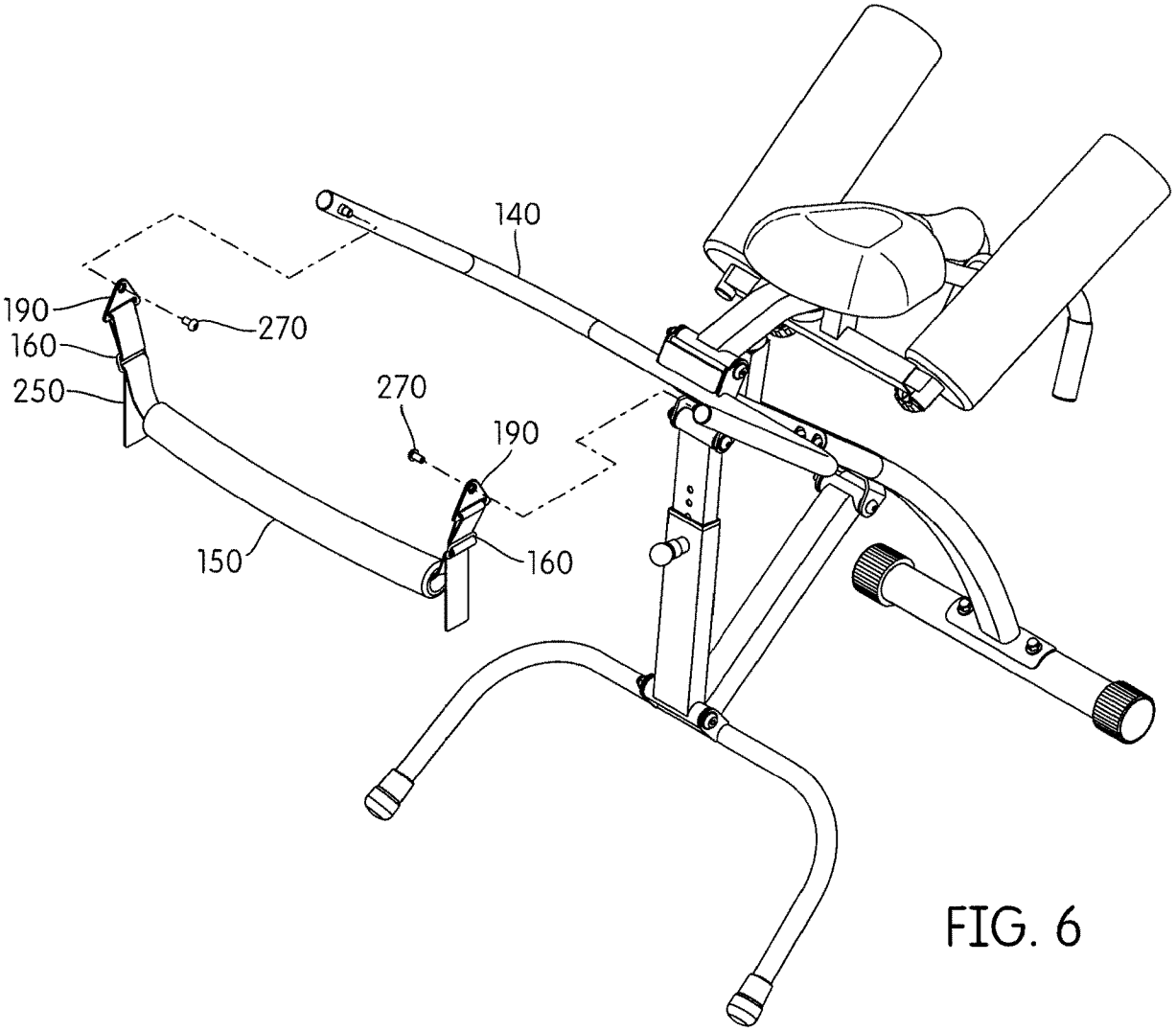
FIG. 6 illustrates an exploded view of another portion being assembled with the assembled portions of FIGS. 2-5.

FIG. 6 illustrates an embodiment of mounting the roller portion 150 to the main frame 140. As shown, in the illustrated embodiment the belt 250 may extend through the roller portion 150, through the buckles 160, and through the hooks 190, before the ends thereof are looped back into the buckles 160. Accordingly, the amount of belt 250 between the hooks 190 may be adjusted via the buckles 160. The hooks 190 may themselves be secured to the main frame 140 by being mounted on pivots protruding therefrom, and being secured by bolts 270. It may therefore be appreciated that the hooks 190 may rotate about the pivots on the main frame 140, allowing the roller portion 150 to swing towards and away from the remainder of the standing traction device 10.

The constituent members and pieces of the standing traction device 10 may be of any appropriate construction or configuration. For example, while in some embodiments the rigid support structures of the standing traction device 10 described above may be generally of integral construction, in the illustrated embodiment some of the components are themselves assemblies. Connecting apertures associated with separable components of the standing traction device 10 may be configured to receive connecting fasteners, such as screws, bolts, or other connecting members. Although in some embodiments the pieces and members are connected by removable fasteners such that the pieces and members are detachable for ease of packaging or other space-saving storage, in other embodiments the standing traction device 10 may be solid, or the pieces or members may be permanently fastened to one another, through welding, one-way fasteners, or so on. Other mechanisms for securing portions of the standing traction device 10 together are additionally or alternatively possible, including but not limited to welding, snap fitting, integral molding, and adhesion.

As also shown, components of the standing traction device 10 may be of a tubular construction. With such a configuration, a portion of one member may be shaped to be received in a portion of another member. Although the use of shaped tubes is desirable due to their structural strength and ease of manufacture, other configurations of the pieces and members may be used to form the pieces and members of standing traction device 10. Furthermore, although in some embodiments various members of the standing traction device 10 may have a curved or circular cross section, while other members may have a rectangular cross section, other combinations of different shaped parts can be used. Accordingly, the illustrated generally tubular configuration of many of the component parts of the standing traction device 10 are also merely exemplary, and other shapes or configurations of the component parts and their assembly are additionally or alternatively possible. For example, to secure components that are not received within one another, apertures extending through each of the component parts may be aligned and joined with a longer fastener extending through both.

Regardless of the assembly of the components thereof, it may be appreciated that the rigid structures of the standing traction device 10 be of any appropriate material, including but not limited to being made of metal, wood, hard plastic, composite materials (such as epoxy coated carbon fiber material), or other material having sufficient durability to support the body weight of a user, and permit exercises while maintaining structural stability of the standing traction device 10. Additionally, the softer materials of the standing traction device 10, including but not limited to the cushion 60, the arm pads 200, endcaps 240, or other materials that may cap prevent protruding cut surfaces prevent scratching of the support surface, or provide a cushioned gripping surface for the user, may be of any appropriate construction or configuration. For example, such members may comprise one or more of rubber, felt, cloth, plastic, or any other appropriate material.

In some embodiments, user engageable materials (e.g., the cushion 60, the arm pads 200, the foam pads 260, or the hand grips 370) may be formed from or contain an ergonomic material to enhance user comfort when engaging the standing traction device 10. Examples of such an ergonomic material include a high friction material for enhanced grip or user engagement, and/or a spongy material to provide for a padded grip or user engagement.

It may be appreciated that when utilized as end caps (e.g., covering hollow openings at the ends of the rigid structures of the standing traction device 10), the softer materials such as those described above may provide impact cushioning, or may otherwise cover sharp or irregularly cut terminal portions of the rigid structures of the standing traction device 10. In some embodiments, one or more of the softer materials may be formed on or otherwise provided on the rigid structures prior to assembly of the rigid structures together.

When using the standing traction device 10, a user may adjust a height of the standing traction device 10 by matching a pivot of the belt 250 (e.g., where the hook 190 couples to the main frame 140) to the user's own pivot point at their hip. To adjust the height, the user may pull the spring pin 120 to retract it from the inner tube 130, and slide the inner tube 130 relative to the outer tube 110. The user may release the spring pin 120 back into another aperture of the inner tube 130, to lock the standing traction device 10 so that the pivot of the belt 250 is either higher or lower than previously configured.

Figure 7:
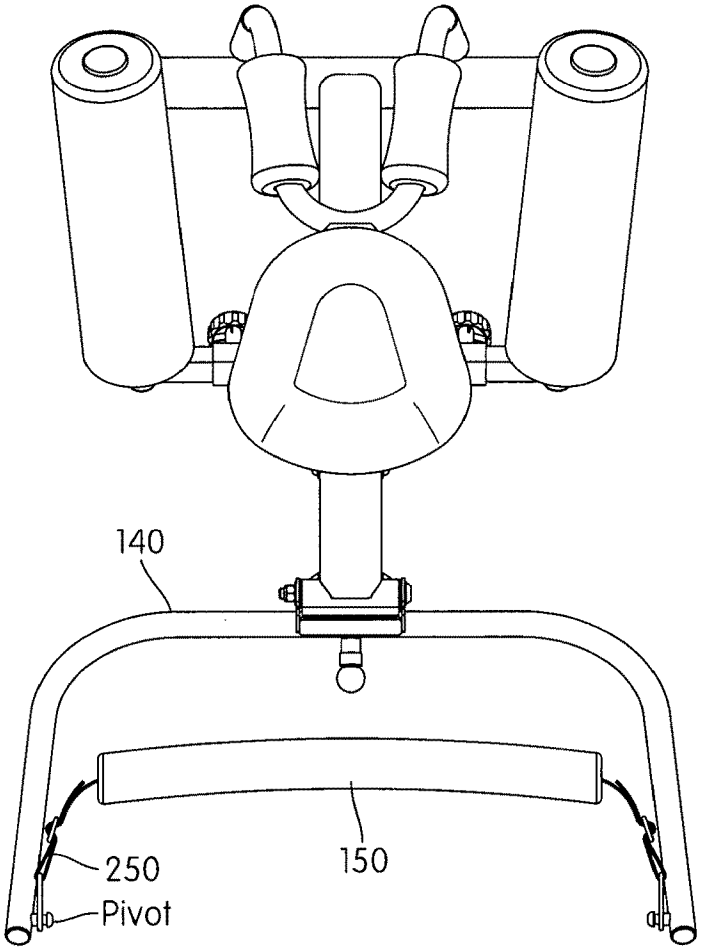
FIG. 7 illustrates a top view of the standing traction device of FIG. 1, illustrating an adjustable portion thereof.

The roller portion 150 and the belt 250 may also be adjusted for the user's comfort and to facilitate a desired stretching exercise. For example, as noted above, the buckle 160 may be utilized to increase or decrease the amount by which the roller portion 150 may extend towards the main frame 140 (e.g., from a top down view, as illustrated in FIG. 7). In an embodiment, a user of average height may adjust the belt 250 so that the roller portion 150 extends to a middle position generally halfway between the pivot of the belt 250 (defined by the hooks 190) and a front edge of the main frame 140 (e.g., adjacent to where the swing arm 80 couples thereto). In an embodiment, positioning the roller portion 150 closer to the pivot of the belt 250 may be useful if the user is taller than a user of average height, or if the user wishes to increase an amount of the stretching. Likewise, positioning the roller portion 150 closer to the front edge of the main frame 140 may be useful if the user is shorter than a user of average height, or if the user wishes to reduce the amount of stretching achieved through the standing traction device.

As noted above, adjustment of the arm pads 200 and the cushion 60 may be achieved through loosening, readjusting, and retightening the adjustment knobs 70 and the locking knobs 90 respectively. In an embodiment, the width between the arm pads 200 should fit the width of the user's upper body. In an embodiment, the back of the user's upper arms should rest of the arm pads 200 during use. In an embodiment the cushion 60 should be positioned to comfortably support the user's chest when using the standing traction device 10.

Figure 8A:
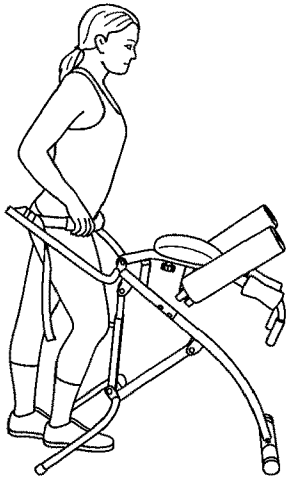
FIGS. 8A-D illustrate user engagement with the standing traction device.
Figure 8B:
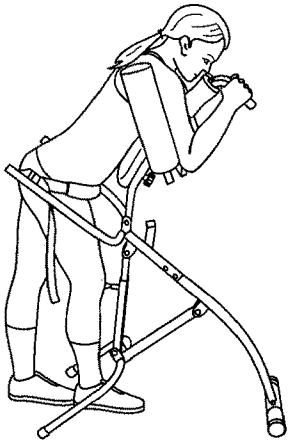
Figure 8C:
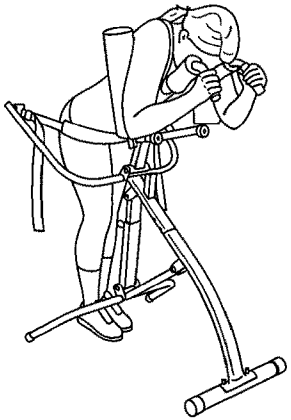
Figure 8D:
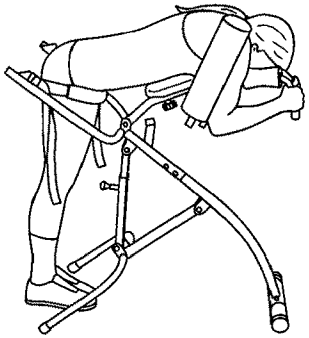

FIGS. 8A-8D illustrate use of an embodiment of the standing traction device 10. Again, prior to use of the standing traction device 10, a user may adjust the standing traction device 10 as described above. As illustrated in FIG. 8A, the user may walk into the standing traction device 10 so that the belt 250 and rolling portion 150 are positioned against the user's waist. The user may then raise the handlebar portion 50 to bring the cushion 60 against the user's chest. Again, the user's torso should fit between the arm pads 200, and the back of the user's arms should rest on the pads 200, as illustrated in FIG. 8B. As shown in FIGS. 8C and 8D, the user may then lean forward into a stretching position, so that the swing arm 80 moves towards the front support 20 of the standing traction device 10. The user may feel stretching in both their spine and their hamstrings during this movement. During exercise, the user may keep both feet flat on the ground during the stretching. Stretching and decompression of the spine may be maintained by holding the stretching position for several minutes, and/or by repeating the motion into and out of the stretching position. Exhaling and breathing slowly during the movement may facilitate relaxation of muscles, which may increase the spinal decompression and stretching effects.

Although this disclosure describes in detail what is currently considered to be the most practical and preferred embodiments, it is to be understood that such detail is solely for the purpose of illustration, and that the scope of protection sought is not limited to the disclosed embodiments, but, on the contrary, is intended to cover modifications and equivalent arrangements that are within the spirit and scope of the appended claims. For example, it is to be understood that, to the extent possible, one or more features of any embodiment can be combined with one or more features of any other embodiment.

What is claimed is:

1. An exercise apparatus comprising:

an adjustable support frame configured to be adjusted to raise or lower a waist portion of the adjustable support frame thereof to accommodate users of different heights standing adjacent thereto on a support surface; and a pivotal upper body support constructed and arranged to pivot relative to the support frame;

a roller portion adjustably coupled to the waist portion of the adjustable support frame via an adjustable belt, the roller portion configured to be engaged by the waist of the user of the exercise apparatus as the user performs the traction exercise;

wherein the upper body support is configured to receive a torso of a user standing adjacent to the adjustable support frame, and facilitate a traction exercise to stretch a spine of the user when the torso of the user engages the pivotal upper body support and bends over the support frame;

wherein the upper body support comprises a pair of arm pads adapted for backs of the user's upper arms to rest as the user pivots the pivotal upper body support relative to the adjustable support frame to resist unintentional movement of the user away from the upper body support.

2. The exercise apparatus of claim 1, wherein the adjustable support frame comprises a front frame assembly pivotally coupled to a rear support and an adjustable linkage, wherein adjustment of the adjustable linkage raises or lowers the waist portion relative to the support surface.

3. The exercise apparatus of claim 2, wherein the adjustable linkage comprises an inner tube and an outer tube, the inner tube being slidable relative to the outer tube to expand or contract a length of the adjustable linkage.

4. The exercise apparatus of claim 3, wherein the inner tube is selectively locked relative to the outer tube by a spring pin.

5. The exercise apparatus of claim 1, wherein the adjustable support frame and the pivotal upper body support comprises one or more bars having a tubular configuration.

6. The exercise apparatus of claim 5, wherein at least one of the one or more bars is wrapped in a grip material.

7. The exercise apparatus of claim 6, wherein the grip material comprises one or more of a high friction material, a spongy material, rubber, felt, cloth, and plastic.

8. The exercise apparatus of claim 1, wherein the pivotal upper body support comprises a handlebar assembly configured to be grasped by one or both hands of the user.

9. The exercise apparatus of claim 8, wherein the handlebar assembly comprises a face rest positioned to receive a face of the user when the torso of the user is received in the pivotal upper body support.

10. The exercise apparatus of claim 1, further comprising a cushion configured to support a chest of the user when the torso of the user is received in the pivotal upper body support.

11. The exercise apparatus of claim 10, wherein a position of the cushion is adjustable relative to the pivotal upper body support.

12. The exercise apparatus of claim 1, wherein the roller portion is configured to pivot relative to the adjustable support frame.

13. The exercise apparatus of claim 1, wherein a spacing between the pair of arm pads is selectively adjustable.

14. The exercise apparatus of claim 1, wherein the pair of arm pads buttress shoulders of the user as the user leans against the upper body support with their torso.

15. An exercise apparatus comprising:

an adjustable support frame configured to be adjusted to raise or lower a waist portion of the adjustable support frame thereof to accommodate users of different heights standing adjacent thereto on a support surface; and a pivotal upper body support constructed and arranged to pivot relative to the support frame;

a roller portion coupled to the waist portion of the adjustable support frame, the roller portion configured to be engaged by the waist of the user of the exercise apparatus as the user performs the traction exercise, wherein the upper body support is configured to receive a torso of a user standing adjacent to the adjustable support frame, and facilitate a traction exercise to stretch a spine of the user when the torso of the user engages the pivotal upper body support and bends over the support frame;

wherein the upper body support comprises a pair of arm pads adapted for backs of the user's upper arms to rest as the user pivots the pivotal upper body support relative to the adjustable support frame to resist unintentional movement of the user away from the upper body support wherein a position of the roller portion is adjustable relative to the waist portion, wherein the roller portion is coupled to the waist portion of the adjustable support frame by an adjustable belt.

16. A method of exercising using an exercise apparatus having an adjustable support frame configured to be adjusted to raise or lower a waist portion of the adjustable support frame thereof to accommodate users of different heights standing adjacent thereto on a support surface, and a pivotal upper body support constructed and arranged to pivot relative to the support frame, a roller portion adjustably coupled to the waist portion of the adjustable support frame via an adjustable belt, the roller portion configured to be engaged by the waist of the user of the exercise apparatus as the user performs the traction exercise, wherein the pivotal upper body support is configured to receive a torso of the user standing adjacent to the adjustable support frame and comprises a pair of arm pads adapted for backs of the user's upper arms to rest to resist unintentional movement of the user away from the upper body support, the method comprising:

standing adjacent to the exercise apparatus with the waist portion adjusted to accommodate a height of the user;

engaging the pivotal upper body support with the torso of the user while standing adjacent to the exercise apparatus; and bending over the waist portion and pivoting the pivotal upper body support while the user is standing, to stretch the spine of the user.

17. The method of claim 16, further comprising pivoting the pivotal upper body support towards the user to engage the pivotal upper body support with the torso of the user.

18. The method of claim 16, further comprising engaging a handlebar assembly of the pivotal upper body support with hands of the user to manipulate the pivoting of the pivotal upper body support.

* * * * *